US009416436B2

(12) United States Patent
Takabayashi et al.

(10) Patent No.: US 9,416,436 B2
(45) Date of Patent: Aug. 16, 2016

(54) STEEL FOR STEAM TURBINE BLADE WITH EXCELLENT STRENGTH AND TOUGHNESS

(71) Applicants: Hiroyuki Takabayashi, Aichi (JP); Shigeki Ueta, Aichi (JP)

(72) Inventors: Hiroyuki Takabayashi, Aichi (JP); Shigeki Ueta, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 44 days.

(21) Appl. No.: 13/869,275

(22) Filed: Apr. 24, 2013

(65) Prior Publication Data

US 2013/0287620 A1 Oct. 31, 2013

(30) Foreign Application Priority Data

Apr. 27, 2012 (JP) ..... 2012-103506
Mar. 18, 2013 (JP) ..... 2013-055435

(51) Int. Cl.

| | |
|---|---|
| ***C22C 38/44*** | (2006.01) |
| ***C22C 38/50*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |

(Continued)

(52) U.S. Cl.

CPC ..... *C22C 38/50* (2013.01); *C21D 6/004* (2013.01); *C21D 9/0068* (2013.01); *C22C 38/001* (2013.01); *C22C 38/02* (2013.01); *C22C 38/04* (2013.01); *C22C 38/06* (2013.01); *C22C 38/42* (2013.01); *C22C 38/44* (2013.01)

(58) Field of Classification Search

CPC ..... C22C 38/44
USPC ..... 148/327; 420/52
See application file for complete search history.

(56) References Cited

U.S. PATENT DOCUMENTS

| | | | |
|---|---|---|---|
| 6,129,514 | A | 10/2000 | Shiga et al. |
| 6,398,504 | B1 | 6/2002 | Arai et al. |
| 7,985,306 | B2 | 7/2011 | Chen et al. |

(Continued)

FOREIGN PATENT DOCUMENTS

| | | | |
|---|---|---|---|
| CN | 1209186 | A | 2/1999 |
| CN | 101892430 | A | 11/2010 |

(Continued)

OTHER PUBLICATIONS

Chinese Office Action issued with respect to application No. 2013101531304 , mail date is Nov. 30, 2015.

(Continued)

*Primary Examiner* — Brian Walck
(74) *Attorney, Agent, or Firm* — Greenblum & Bernstein, P.L.C.

(57) ABSTRACT

The present invention aim at providing a steel for steam turbine blades which is excellent in terms of strength and toughness. The steel of the present invention has a composition which contains, in terms of % by mass, 0.02-0.10% of C, up to 0.25% of Si, 0.001-0.10% of Mn, up to 0.010% of P, up to 0.010% of S, 8.5-10.0% of Ni, 10.5-13.0% of Cr, 2.0-2.5% of Mo, 0.001-0.010% of N, 1.15-1.50% of Al, less than 0.10% of Cu, up to 0.20% of Ti, and the remainder being incidental impurities and Fe, and which satisfies 6.0≤Ni/Al≤8.0, 9.0≤Nieq≤11.0 and 17.0≤Creq≤19.0, in which $$Nieq=[Ni]+0.11[Mn]-0.0086([Mn]^2)+0.44[Cu]+18.4[N]+24.5[C]$$

$$Creq=[Cr]+1.21[Mo]+0.48[Si]+2.2[Ti]+2.48[Al].$$

2 Claims, 1 Drawing Sheet

(51) Int. Cl.
*C21D 6/00* (2006.01)
*C21D 9/00* (2006.01)

(56) References Cited

U.S. PATENT DOCUMENTS

| | | | | |
|---|---|---|---|---|
| 8,097,098 | B2 | 1/2012 | Montagnon | |
| 2006/0118215 | A1* | 6/2006 | Hirakawa et al. | 148/607 |
| 2010/0139817 | A1 | 6/2010 | Montagnon | |
| 2010/0193088 | A1 | 8/2010 | Chen et al. | |

FOREIGN PATENT DOCUMENTS

| | | | |
|---|---|---|---|
| EP | 1728886 | A1 | 12/2006 |
| JP | 59-222558 | | 12/1984 |
| JP | 02-310339 | | 12/1990 |
| JP | 05-125490 | | 5/1993 |
| JP | 2000-158183 | A | 6/2000 |
| JP | 2005-171339 | A | 6/2005 |
| JP | 3661456 | | 6/2005 |
| JP | 3666315 | | 6/2005 |
| JP | 3793667 | | 7/2006 |
| JP | 2008-525637 | | 7/2008 |
| JP | 2008-546912 | | 12/2008 |
| WO | 2006-068610 | | 6/2006 |
| WO | 2007-003748 | | 1/2007 |

OTHER PUBLICATIONS

Notification of Information Offer issued by Japanese Patent Office, dated Jun. 7, 2016 with English translation.

* cited by examiner

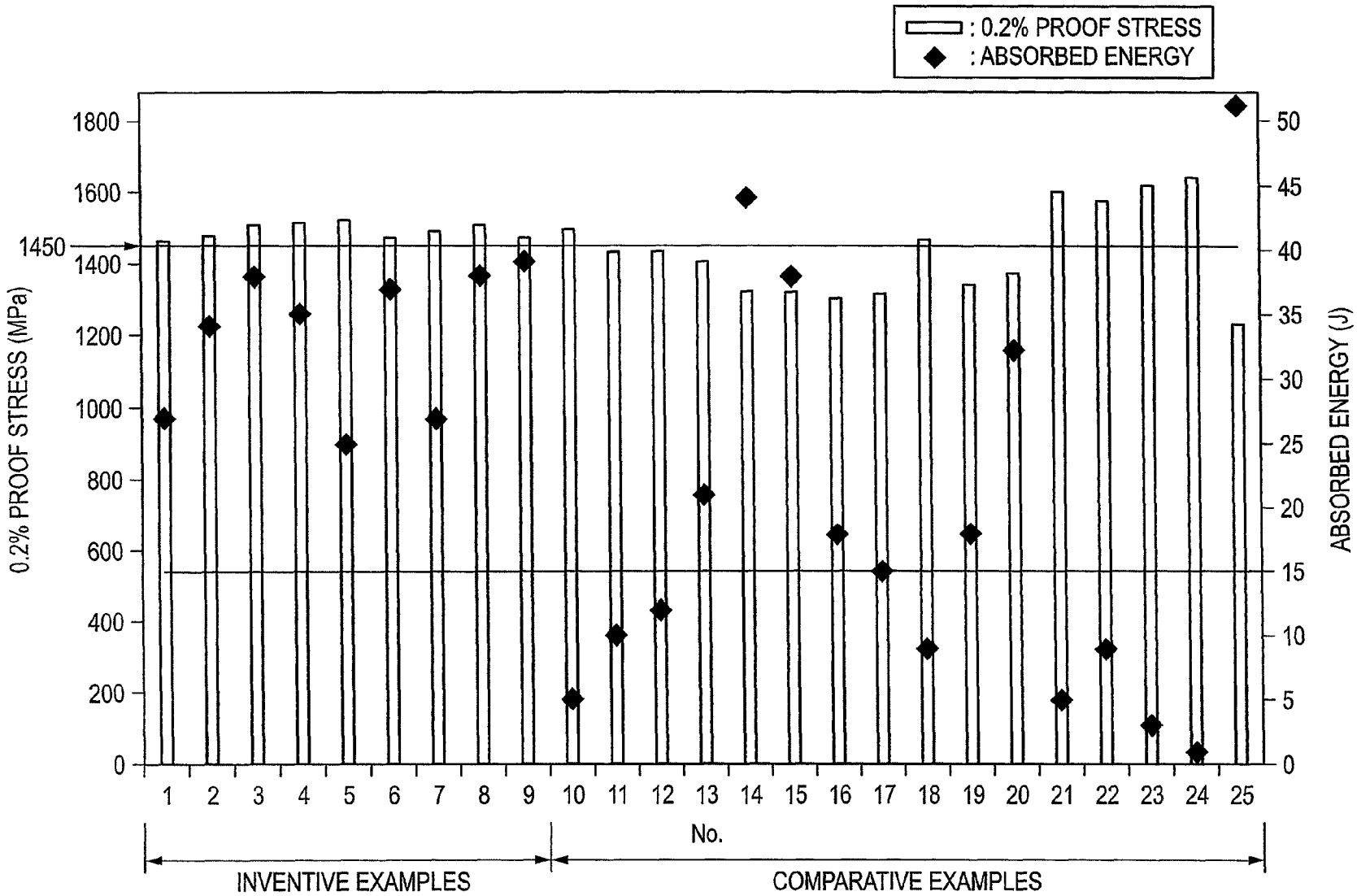
: 0.2% PROOF STRESS
: ABSORBED ENERGY
0.2% PROOF STRESS (MPa)
ABSORBED ENERGY (J)
1450
No.
INVENTIVE EXAMPLES
COMPARATIVE EXAMPLES

STEEL FOR STEAM TURBINE BLADE WITH EXCELLENT STRENGTH AND TOUGHNESS

FIELD OF THE INVENTION

The present invention relates to a steel for steam turbine blades which is excellent in terms of strength and toughness. More particularly, the invention relates to a steel for steam turbine blades which is constituted of a precipitation hardening type martensitic stainless steel.

BACKGROUND OF THE INVENTION

Hitherto, JIS SUS630, which is a precipitation hardening type martensitic stainless steel, has been used as a steel for the turbine blades of steam turbines for use in thermal electric power plants.

The longer the final-stage turbine blades (moving blades) in low-pressure turbines or the like, the more the blades are effective from the standpoint of the energy efficiency of the steam turbines.

In recent years, there is a growing intense desire for improvements in the energy efficiency of steam turbines used in thermal electric power plants, and it is becoming increasingly necessary, with this trend, to further increase the length of turbine blades, i.e., further elongate turbine blades.

Incidentally, a further elongation of turbine blades results in an increase in the centrifugal force imposed on the turbine blades.

Turbine blades are hence required to not only have high strength sufficient to enable the turbine blades to withstand the increased high centrifugal force but also have impact resistance, i.e., resistance to collisions of foreign matter, e.g., separated scales.

Specifically, from the standpoint of coping with elongations of turbine blades, in particular, a further elongation of final-stage turbine blades, it is desirable that a steel for turbine blades should have a strength as high as 1,450 MPa or above in terms of 0.2% proof stress and a toughness as high as 15 J or above in terms of Charpy impact value (absorbed energy).

In this regard, SUS630, which has conventionally been used as a steel for turbine blades, is insufficient in strength although sufficient in toughness. There has hence been a desire for development of a material which has even higher strength while retaining the high toughness of SUS630.

As a prior-art technique which is relevant to the present invention, the following patent document 1 discloses a titanium-based alloy that contains, in terms of % by weight, 4-8% of aluminum, 4-8% of vanadium, and 1-4% of tin, as a material for accommodating elongations of turbine blades.

However, this material has a 0.2% proof stress as poor as 94.5 kg/mm$^2$ or less, and is still insufficient in strength.

In addition, this alloy is a titanium-based alloy and is different from the steel of the invention, which will be described later.

Meanwhile, the following patent document 2 discloses, as a material for the final-stage moving blades of low-pressure turbines, a martensitic steel which contains, in terms of % by weight, 0.19-0.25% of carbon, up to 0.1% of silicon, up to 0.4% of manganese, 8.0% or more and less than 13.0% of chromium, more than 2% and 3.5% or less of nickel, more than 2% and 3.5% or less of molybdenum, 0.05-0.35% of vanadium, 0.02-0.20% of one or two of niobium and tantalum, and 0.04-0.15% of nitrogen and which has a wholly tempered martensite structure.

However, this material has too high hardness after a solution treatment because of the high carbon content and hence has poor productivity. In addition, there is a possibility that the chromium in the matrix is consumed by carbon during the formation of carbides, resulting in a decrease in corrosion resistance.

Moreover, this material differs from the steel of the present invention in the ranges of carbon and nickel contents, and is different from the present invention.

Furthermore, the following patent document 3 discloses, as a material for accommodating turbine blade elongations, a steel which contains, in terms of % by weight, 0.19-0.32% of carbon, up to 0.5% of silicon, up to 1.5% of manganese, 8-13% of chromium, 2-3.5% of nickel, 1.5-4% of molybdenum, 0.05-0.35% of vanadium, 0.02-0.3% of one or two of niobium and tantalum, and 0.04-0.15% of nitrogen and in which the value of Mo/C is 5-22.

This steel disclosed in patent document 3 also has a high carbon content and has the same problems as the steel disclosed in patent document 2. Moreover, this steel differs from the present invention in the contents of carbon and nickel.

As still another conventional technique relevant to the present invention, the following patent document 4 discloses a high-strength corrosion-resistant steel characterized by comprising, in terms of % by weight, up to 0.15% of carbon, up to 1% of silicon, up to 2% of manganese, 9-15% of chromium, 6-11% of nickel, 1-4% of molybdenum, 0.1-5% of copper, 0.5-2% of aluminum, and 0.001-0.1% of nitrogen, with the remainder being iron and incidental impurities.

However, this steel differs from the present invention in that this steel is intended to be used in applications such as fasteners for aircraft, parts for petrochemical apparatus, etc., and that this steel has a copper content as high as 0.1-5% and does not satisfy all of the expression (1), expression (2), and expression (3) according to the present invention which will be described later.

The following patent document 5 discloses a martensitic stainless steel excellent in terms of strength, spring properties, and formability, the stainless steel being characterized by containing, in terms of % by weight, 10-19% of chromium, 5.5-10% of nickel, up to 0.4% of silicon, up to 2.0% of manganese, 1.10-2.00% of aluminum, 0.5-2.0% of titanium, up to 0.03% of carbon, and up to 0.04% of nitrogen and satisfying $Cr+2Ni+Mn+Al \leq 35\%$, $2Ni+Mn \geq 11\%$, and $Cr+Al \geq 11.10\%$, with the remainder being iron and incidental impurities.

The steel disclosed in patent document 5 also differs from the present invention in that this steel is intended to be used in applications such as gasket materials for engines or chemical plants, etc., that this steel contains titanium as an alloying element in an amount as large as 0.5-2.0%, and that this steel does not satisfy all of the expression (1), expression (2), and expression (3) according to the present invention.

Moreover, the following patent document 6 discloses a martensitic stainless steel characterized by having a composition which contains, in terms of wt %, up to 0.07% of carbon, up to 1.5% of silicon, 0.2-5% of manganese, 0.01-0.4% of sulfur, 10-15% of chromium, 7-14% of nickel, 1-6% of molybdenum, 1-3% of copper, 0.3-2.5% of titanium, 0.2-1.5% of aluminum, and up to 0.1% of nitrogen, with the remainder being iron and impurities commonly present, and by containing titanium sulfide.

The steel disclosed in patent document 6 also differs from the present invention in that this steel is intended to be used in applications such as springs and the like, that the steel contains copper and titanium as alloying elements in amounts as large as 1-3% and 0.3-2.5%, respectively, and that this steel does not satisfy all of the expression (1), expression (2), and expression (3) according to the present invention.

Furthermore, the following patent document 7 discloses a martensitic stainless steel characterized by having a composition which contains, in terms of % by weight, $9\% \leq Cr \leq$ 13%, 1.5%≤Mo≤3%, 8%≤Ni≤14%, 1%≤Al≤2%, 0.5%≤Ti≤1.5% with the proviso that Al+Ti≥2.25%, (detection limit)≤Co≤2%, (detection limit)≤W≤1% with the proviso that Mo+(W/2)≤3%, (detection limit)≤P≤0.02%, (detection limit)≤S≤0.0050%, (detection limit)≤N≤0.0060%, (detection limit)≤C≤0.025%, (detection limit)≤Cu≤0.5%, (detection limit)≤Mn≤3%, (detection limit)≤Si≤0.25%, and (detection limit)≤O≤0.0050%, and by satisfying Ms (° C.)=1302−42Cr−63Ni−30Mo+20Al−15W−33Mn−28Si−30Cu−13Co+10Ti≥50 and further satisfying (Cr equivalent)/(Ni equivalent)≤1.05 with the proviso that Cr equivalent (%)=Cr+2Si+Mo+1.5Ti+5.5Al+0.6W and Ni equivalent (%)=2Ni+0.5Mn+30C+25N+Co+0.3Cu.

The steel disclosed in patent document 7 also differs from the present invention in that this steel contains titanium as an alloying element in an amount as large as 0.5-1.5% and that this steel does not satisfy all of the expression (1), expression (2), and expression (3) according to the present invention.

Patent Document 1: Japanese Patent No. 3666315

Patent Document 2: Japanese Patent No. 3661456

Patent Document 3: Japanese Patent No. 3793667

Patent Document 4: JP-A-59-222558

Patent Document 5: JP-A-2-310339

Patent Document 6: JP-T-2008-525637 (The term "JP-T" as used herein means a published Japanese translation of a PCT patent application.)

Patent Document 7: JP-T-2008-546912

SUMMARY OF THE INVENTION

The present invention has been accomplished under the circumstances described above, and an object of the invention is to provide a high-strength high-toughness steel for steam turbine blades which is capable of combining a strength as high as 1,450 MPa or above in terms of 0.2% proof stress and a toughness as high as 15 J or above in terms of Charpy impact value.

Namely, the present invention provides a steel for steam turbine blades, which is excellent in terms of strength and toughness, said steel having a composition which contains, in terms of % by mass, 0.02-0.10% of C,
up to 0.25% of Si,
0.001-0.10% of Mn,
up to 0.010% of P,
up to 0.010% of S,
8.5-10.0% of Ni,
10.5-13.0% of Cr,
2.0-2.5% of Mo,
0.001-0.010% of N,
1.15-1.50% of Al,
less than 0.10% of Cu,
up to 0.20% of Ti, and the remainder being incidental impurities and Fe, and which satisfies the following expression (1), expression (2), and expression (3):

$$6.0 \le Ni/Al \le 8.0 \quad \text{expression (1)}$$

$$9.0 \le Nieq \le 11.0 \quad \text{expression (2)}$$

$$17.0 \le Creq \le 19.0 \quad \text{expression (3)}$$

wherein $$Nieq=[Ni]+0.11[Mn]-0.0086([Mn]^2)+0.44[Cu]+18.4[N]+24.5[C]$$

$$Creq=[Cr]+1.21[Mo]+0.48[Si]+2.2[Ti]+2.48[Al]$$

(wherein the atomic symbols in expression (1) and in the equations defining Nieq and Creq represent the contents in % by mass of the respective elements).

Essential points of the invention, which has the configuration shown above, are as follows. Copper and titanium, which are causative of a decrease in toughness, were not added positively (but may be present unaviodably). The contents of alloying elements such as C, Si, Mn, Ni, Cr, Mo, and Al in the precipitation hardening type martensitic steel have been regulated to contents suitable for high strength and high toughness. The contents of nickel and aluminum, which are the constituent elements of the Ni—Al intermetallic compound that serves to enhance the strength of the precipitation hardening type martensitic steel, have been balanced so that the proportion of nickel to aluminum, Ni/Al, is suitable for attaining both high strength and high toughness. In particular, the inventors directed attention to a balance between Nieq as an index to stabilization of austenite and Creq as an index to stabilization of ferrite, which govern the structure of the steel, and have determined a proper balance between Nieq and Creq for inhibiting a δ-ferrite phase from remaining after a homogenizing heat treatment (up to 1,240° C.) and for enabling the structure of the steel that has not undergone an aging treatment (that has undergone a solution treatment and a sub-zero treatment) to have a low retained-austenite content and, conversely, have a high martensite content. Consequently, the values of Nieq and Creq have been regulated so as to be within the specific ranges shown above.

According to the invention, which is based on such essential points, it is possible to obtain a high-strength high-toughness steel for turbine blades that has a 0.2% proof stress of 1,450 MPa or higher and a Charpy impact value (absorbed energy) of 15 J or higher. This steel is capable of accommodating the elongation of turbine blades which is required in recent years.

The steel for steam turbine blades of the invention can be produced in the following manner.

First, a raw material containing low impurity or scrap is used as a raw material, and this raw material is melted by atmospheric arc melting, melting with an atmospheric induction furnace, melting with a vacuum induction furnace, etc.

In the case where a higher degree of cleanliness is required, the material is thereafter remelted by vacuum slug melting, electromelting of slug, vacuum arc melting, etc. This remelting can be repeatedly conducted two or more times according to need.

However, in the case where the first melting is melting with a vacuum induction furnace, remelting can be omitted.

After the melting step described above, the steel ingot obtained through the melting is subjected to a homogenizing heat treatment.

The homogenizing heat treatment can be accomplished by heating and holding the steel ingot under the conditions of a temperature of 1,150-1,240° C. and a period of 10 hours or longer. After the heating, the steel ingot is cooled to room temperature. Alternatively, the steel ingot is transferred to the next step of forging, without being cooled.

In this forging step, the steel ingot is forged under the conditions of 900-1,240° C. and 1 hour or longer and under the conditions of a final forging temperature of 900° C., and is then cooled with air. This forging step can be performed successively to the homogenizing heat treatment as stated above.

In the case of the steel for steam turbine blades of the invention, a solution treatment is first conducted prior to the aging treatment to be performed later. The solution treatment can be conducted, for example, under the conditions of a temperature of 900-1,100° C. and a heating period of 1-10 hours. After the heating, the steel is cooled by air cooling, air blast cooling, oil cooling, water cooling, or the like.

After the solution treatment, a sub-zero treatment is conducted.

This sub-zero treatment can be accomplished by holding the steel under the temperature condition of 0° C. or less over a period of 1-10 hours.

After this sub-zero treatment, an aging treatment is conducted.

The aging treatment is conducted, for example, under the conditions of 400-600° C. and 1-24 hours, and the steel is thereafter cooled by air cooling.

BRIEF DESCRIPTION OF THE DRAWING

FIG. 1 is a presentation which shows the values of 0.2% proof stress and of the magnitude of absorbed energy in a Charpy impact test which were obtained in Examples according to the invention and Comparative Examples.

DETAILED DESCRIPTION OF THE INVENTION

Reasons for limiting the contents of the chemical components in the invention are explained below.

Carbon (C): 0.02-0.10%

Carbon precipitates $M_2X$-type carbonitrides to contribute to an improvement in matrix strength. Carbon further contributes to a reduction in the diameter of prior-austenite (γ) grains. For obtaining these effects, it is necessary that carbon should be contained in an amount of 0.02% or more.

On the other hand, in case where carbon is contained in an amount exceeding 0.10%, it becomes necessary to heighten the solid-solution formation temperature of the $M_2X$-type carbonitrides and coarser austenite grains generate upon the formation of solid solution, resulting in unevenness of properties. Consequently, the upper limit thereof is 0.10%.

Silicon (Si): ≤0.25%

In case where silicon is contained in a large amount exceeding 0.25%, the steel has reduced toughness and ductility. Consequently, the upper limit is 0.25%.

In addition, although there is no problem in terms of the characteristics of steel in case where the content of silicon is 0.25% or less, since silicon is utilized also as a deoxidizing material during melting, it is preferable to add silicon in an amount of 0.05% or more.

Manganese (Mn): 0.001-0.10%

Manganese is incorporated in an amount of 0.001% or more in order to inhibit intergranular segregation of sulfur. However, in case where manganese is contained in a large amount exceeding 0.10%, sulfides are formed in an increased amount to impair the toughness of the steel. Consequently, the upper limit is 0.10%. The content thereof is preferably 0.05% or less.

Phosphorus (P): ≤0.010%

Phosphorus is an element which segregates at grain boundaries to lower hot workability. In the invention, the content thereof is regulated to 0.010% or less.

Sulfur (S): ≤0.010%

Sulfur also is an element which segregates at grain boundaries to lower hot workability. In the invention, the content thereof is regulated to 0.010% or less.

Nickel (Ni): 8.5-10.0%

Nickel in the invention is an important element which precipitates a Ni—Al intermetallic compound to contribute to an improvement in matrix strength. For this purpose, nickel is incorporated in an amount of 8.5% or more. The amount of nickel to be incorporated is more preferably 8.6% or more, even more preferably 8.8% or more.

On the other hand, in case where nickel is contained in a large amount exceeding 10.0%, the strength of the steel becomes deteriorated due to the increase of retained austenite. Consequently, the upper limit is 10.0%. The content thereof is preferably 9.8% or less, more preferably 9.5% or less.

Chromium (Cr): 10.5-13.0%

Chromium is incorporated in order to ensure corrosion resistance. However, in case where the content thereof is less than 10.5%, sufficient corrosion resistance is not obtained and $M_{23}C_6$-type carbides which are coarser than the $M_2X$-type carbonitrides are stabilized, resulting in a decrease in 0.2% proof stress. Consequently, chromium is contained in an amount of 10.5% or more, preferably 11.0% or more.

Chromium contributes also to the regulation of martensite transformation initiation temperature (Ms point). As the content thereof is reduced within a range of contents not less than the lower limit, the Ms point rises and this results in a decrease in the content of retained austenite in the steel which has undergone a solution treatment or a sub-zero treatment. Chromium has the effect of thus improving the homogeneity of the microstructure to improve the 0.2% proof stress.

Conversely, as the chromium content is increased, the Ms point declines and, hence, the content of retained austenite increases gradually.

In case where chromium is contained in an amount exceeding the upper limit of 13.0%, the content of retained austenite before aging is excessively high, resulting in a decrease in 0.2% proof stress. Consequently, in the invention, the upper limit of chromium content is 13.0%. The upper limit thereof is preferably 12.3%, more preferably 12.0%.

Molybdenum (Mo): 2.0-2.5%

Molybdenum precipitates $M_2X$-type carbonitrides to contribute to an improvement in matrix strength. Molybdenum further contributes to a reduction in the diameter of prior-austenite grains. In order to obtain these effects, molybdenum is incorporated in the invention in an amount of 2.0% or more, more preferably 2.1% or more.

On the other hand, in case where molybdenum is excessively contained in an amount larger than 2.5%, the solid-solution formation temperature of the $M_2X$-type carbonitrides rises and coarser austenite grains generate upon the formation of solid solution, resulting in unevenness of properties. Consequently, the upper limit is 2.5%. Preferably, the upper limit is 2.4%.

Nitrogen (N): 0.001-0.010%

Nitrogen, although contained in $M_2X$-type carbonitrides, combines with the aluminum which has been added as a strengthening element. Nitrogen thus forms a nitride and thereby exerts a considerable influence to lower the toughness and ductility of the steel. Consequently, in the invention, the content of nitrogen is regulated to 0.010% or less.

The lower the content of nitrogen, the better the steel. However, to reduce the content thereof to below 0.001% results in an increase in production cost. Meanwhile, when nitrogen is contained in an amount of 0.010% or less, influences thereof on strength and toughness are little. Consequently, nitrogen content of 0.001-0.010% is permissible.

Aluminum (Al): 1.15-1.50%

Aluminum is an important element which forms a Ni—Al intermetallic compound together with nickel. In the invention, aluminum is incorporated in an amount of 1.15% or more in order to improve matrix strength through precipitation of Ni—Al. The content thereof is more preferably 1.20% or higher, even more preferably 1.25% or higher.

On the other hand, in case where aluminum is contained in a large amount exceeding 1.50%, the result is a decrease in the toughness and ductility of the steel. Consequently, the upper limit is 1.50%. The upper limit of the content thereof is preferably 1.45%, more preferably 1.40%.

Copper (Cu): <0.10%

Copper reduces the toughness of the steel through precipitation thereof. Consequently, in the invention, copper is not added, and the content of copper as an impurity is regulated to below 0.10%.

Titanium (Ti): ≤0.20%

Titanium also reduces the toughness of the steel through precipitation thereof and through an increase in the content of inclusions. Consequently, in the invention, the content of titanium as a harmful element is regulated to 0.20% or less.

6.0≤Ni/Al≤8.0 (expression (1))

In case where the value of Ni/Al is less than 6.0, the content of aluminum relative to the content of nickel is too high and this results in a decrease in toughness and ductility, although bringing about an improvement in strength due to an increase in the amount of a Ni—Al intermetallic compound. Consequently, the lower limit is 6.0. The lower limit thereof is preferably 6.5.

On the other hand, in case where the value thereof exceeds 8.0, the content of retained austenite increases considerably, and it becomes difficult to reduce the amount of retained austenite by reducing the content of chromium or molybdenum. Consequently, the upper limit is 8.0. The upper limit of the value thereof is preferably 7.5.

9.0≤Nieq≤11.0 (expression (2)), 17.0≤Creq≤19.0 (expression (3))

With respect to Nieq and Creq, by using a proper combination of values thereof, i.e., by regulating the values of Nieq and Creq to 9.0-11.0 and 17.0-19.0, respectively, a δ-ferrite phase can be inhibited from remaining after a homogenizing heat treatment (up to 1,240° C.) and the structure of the steel that has not undergone an aging treatment (that has undergone a solution treatment and a sub-zero treatment) can be made to have a reduced retained-austenite content and an increased content of martensite generated. As a result, the strength of the steel can be effectively heightened.

9.0≤Nieq≤11.0

In case where the value of Nieq is less than 9.0, the steel has insufficient strength. Consequently, the value of Nieq is 9.0 or larger. On the other hand, in case where the value of Nieq is larger than 11.0, the steel that has not undergone an aging treatment has an increased retained-austenite content and, hence, reduced strength. Consequently, the upper limit is 11.0.

17.0≤Creq≤19.0

In case where the value of Creq is less than 17.0, the steel has insufficient strength. Consequently, the lower limit is 17.0. On the other hand, in case where the value of Creq is larger than 19.0, a δ-ferrite phase remains after a homogenizing heat treatment, resulting in a decrease in impact value. In addition, the steel that has not undergone an aging treatment has an increased retained-austenite content, resulting in a decrease in steel strength. Consequently, the upper limit is 19.0.

EXAMPLES

Fifty kilograms of a steel having each of the compositions shown in Table 1 was melted in a vacuum induction furnace and then cast to obtain an ingot. Thereafter, the ingot was subjected to a homogenizing heat treatment under the conditions of 1,220° C.×20 hr and air cooling, subsequently forged into a round bar having a diameter of 22 mm under the conditions of an initial temperature of 1,220° C. and a final temperature of 900° C., and then cooled with air.

Thereafter, each of the round bars was subjected to a solution treatment under the conditions of 1,000° C.×1 hr and air cooling and successively subjected to a sub-zero treatment under the conditions of −30° C.×3 hr.

Subsequently, an aging treatment was conducted under the conditions of 530° C.×4 hr and air cooling.

The materials to be tested which had been obtained through these treatments were subjected to a hardness test, a tensile test, and a Charpy impact test to determine the hardness (Rockwell hardness), 0.2% proof stress, and Charpy impact value (absorbed energy) of each material.

The results obtained are shown in Table 1 and FIG. 1.

The hardness measurement, tensile test, and Charpy impact test were conducted by the following methods under the following conditions.

TABLE 1

| | | Component (mass %) | | | | | | | | | | | | | Parameter | | | Hardness | 0.2% proof stress | Charpy |
|---|---|---|---|---|---|---|---|---|---|---|---|---|---|---|---|---|---|---|---|---|
| | | C | Si | Mn | P | S | Ni | Cr | Mo | N | Al | Cu | Ti | Fe | Ni/Al | Nieq | Creq | HRC | MPa | J |
| Examples of the Invention | 1 | 0.04 | 0.06 | 0.01 | 0.004 | 0.001 | 8.9 | 12.7 | 2.1 | 0.006 | 1.28 | 0.07 | 0.07 | bal. | 7.0 | 10.0 | 18.6 | 47.2 | 1465 | 27 |
| | 2 | 0.02 | 0.19 | 0.01 | 0.003 | 0.002 | 9.1 | 12.6 | 2.2 | 0.004 | 1.24 | 0.04 | 0.08 | bal. | 7.3 | 9.7 | 18.6 | 48.0 | 1481 | 34 |
| | 3 | 0.03 | 0.09 | 0.01 | 0.005 | 0.003 | 9.2 | 12.5 | 2.2 | 0.003 | 1.26 | 0.03 | 0.03 | bal. | 7.3 | 10.0 | 18.4 | 47.8 | 1509 | 38 |
| | 4 | 0.06 | 0.08 | 0.01 | 0.006 | 0.002 | 9.4 | 11.5 | 2.2 | 0.007 | 1.25 | 0.06 | 0.06 | bal. | 7.5 | 11.0 | 17.4 | 48.0 | 1516 | 35 |
| | 5 | 0.05 | 0.11 | 0.01 | 0.004 | 0.003 | 9.7 | 11.1 | 2.2 | 0.005 | 1.38 | 0.05 | 0.04 | bal. | 7.0 | 11.0 | 17.3 | 48.4 | 1525 | 25 |
| | 6 | 0.03 | 0.16 | 0.01 | 0.003 | 0.001 | 9.9 | 11.0 | 2.4 | 0.004 | 1.25 | 0.03 | 0.03 | bal. | 7.9 | 10.7 | 17.1 | 47.3 | 1475 | 37 |
| | 7 | 0.04 | 0.09 | 0.01 | 0.004 | 0.002 | 9.7 | 11.6 | 2.1 | 0.006 | 1.39 | 0.04 | 0.05 | bal. | 7.0 | 10.8 | 17.7 | 47.8 | 1490 | 27 |
| | 8 | 0.05 | <0.01 | 0.01 | 0.005 | 0.003 | 9.1 | 12.4 | 2.1 | 0.004 | 1.23 | 0.03 | 0.03 | bal. | 7.4 | 10.4 | 18.1 | 47.9 | 1509 | 39 |
| | 9 | 0.03 | <0.01 | 0.01 | 0.003 | 0.001 | 9.8 | 11.1 | 2.4 | 0.005 | 1.24 | 0.03 | 0.03 | bal. | 7.9 | 10.6 | 17.1 | 47.3 | 1475 | 38 |
| Comparative Examples | 10 | 0.15 | 0.08 | 0.01 | 0.003 | 0.001 | 9.1 | 12.4 | 2.3 | 0.005 | 1.28 | 0.04 | 0.08 | bal. | 7.1 | 12.9 | 18.6 | 52.2 | 1498 | 5 |
| | 11 | 0.04 | 0.40 | 0.01 | 0.006 | 0.003 | 9.0 | 11.9 | 2.4 | 0.004 | 1.31 | 0.03 | 0.07 | bal. | 6.9 | 10.1 | 18.4 | 48.0 | 1434 | 10 |
| | 12 | 0.03 | 0.09 | 0.30 | 0.004 | 0.002 | 9.2 | 12.0 | 2.3 | 0.003 | 1.30 | 0.03 | 0.08 | bal. | 7.1 | 10.0 | 18.2 | 47.8 | 1442 | 12 |
| | 13 | 0.04 | 0.16 | 0.01 | 0.006 | 0.001 | 7.9 | 12.7 | 2.2 | 0.006 | 1.16 | 0.04 | 0.04 | bal. | 6.8 | 9.0 | 18.4 | 46.8 | 1409 | 21 |
| | 14 | 0.05 | 0.10 | 0.01 | 0.005 | 0.002 | 10.8 | 12.3 | 2.0 | 0.005 | 1.22 | 0.05 | 0.05 | bal. | 8.9 | 12.1 | 17.9 | 43.4 | 1326 | 44 |
| | 15 | 0.04 | 0.15 | 0.01 | 0.005 | 0.003 | 9.1 | 9.5 | 2.5 | 0.004 | 1.30 | 0.06 | 0.06 | bal. | 7.0 | 10.2 | 16.0 | 43.5 | 1322 | 38 |
| | 16 | 0.03 | 0.11 | 0.01 | 0.006 | 0.002 | 8.8 | 13.5 | 2.2 | 0.006 | 1.34 | 0.03 | 0.08 | bal. | 6.6 | 9.7 | 19.7 | 43.1 | 1306 | 18 |
| | 17 | 0.04 | 0.12 | 0.01 | 0.006 | 0.003 | 9.0 | 11.7 | 1.0 | 0.004 | 1.33 | 0.04 | 0.08 | bal. | 6.8 | 10.1 | 16.4 | 43.2 | 1318 | 15 |

TABLE 1-continued

| | Component (mass %) | | | | | | | | | | | | | Parameter | | | Hardness | 0.2% proof stress | Charpy |
|---|---|---|---|---|---|---|---|---|---|---|---|---|---|---|---|---|---|---|---|
| | C | Si | Mn | P | S | Ni | Cr | Mo | N | Al | Cu | Ti | Fe | Ni/Al | Nieq | Creq | HRC | MPa | J |
| 18 | 0.02 | 0.15 | 0.01 | 0.004 | 0.002 | 8.9 | 11.8 | 2.9 | 0.004 | 1.33 | 0.05 | 0.07 | bal. | 6.7 | 9.5 | 18.8 | 47.8 | 1470 | 9 |
| 19 | 0.04 | 0.13 | 0.01 | 0.003 | 0.003 | 9.2 | 12.2 | 2.0 | 0.120 | 1.31 | 0.06 | 0.06 | bal. | 7.0 | 12.4 | 18.1 | 44.2 | 1346 | 18 |
| 20 | 0.06 | 0.06 | 0.01 | 0.005 | 0.002 | 9.3 | 12.3 | 2.0 | 0.005 | 1.11 | 0.04 | 0.04 | bal. | 8.4 | 10.9 | 17.6 | 47.6 | 1376 | 32 |
| 21 | 0.05 | 0.13 | 0.01 | 0.006 | 0.001 | 9.5 | 11.9 | 2.2 | 0.005 | 1.65 | 0.06 | 0.06 | bal. | 5.8 | 10.8 | 18.8 | 49.3 | 1612 | 5 |
| 22 | 0.05 | 0.11 | 0.01 | 0.004 | 0.001 | 8.9 | 12.0 | 2.1 | 0.004 | 1.28 | 0.38 | 0.05 | bal. | 7.0 | 10.4 | 17.9 | 48.8 | 1588 | 9 |
| 23 | 0.06 | 0.12 | 0.01 | 0.004 | 0.002 | 9.1 | 12.1 | 2.3 | 0.002 | 1.32 | 0.05 | 0.42 | bal. | 6.9 | 10.6 | 19.1 | 49.7 | 1624 | 3 |
| 24 | 0.04 | 0.10 | 0.01 | 0.005 | 0.002 | 9.0 | 12.0 | 1.9 | 0.003 | 1.31 | 0.30 | 0.41 | bal. | 6.9 | 10.2 | 18.5 | 50.2 | 1645 | 1 |
| 25 | 0.06 | 0.20 | 0.40 | 0.009 | 0.001 | 4.9 | 16.5 | 0.03 | 0.021 | 0.01 | 3.03 | 0.01 | bal. | 490 | 8.1 | 16.6 | 43.0 | 1236 | 51 |

[Note]
In Examples 8 and 9 of the present invention, Creq was calculated with regarding Si = 0.01.

(I) Hardness (Rockwell hardness) Measurement

In accordance with the method for Rockwell hardness test as provided for in JIS Z 2245, a hardness measurement was conducted with scale C.

Samples were cut out along planes which crossed the forging direction, and the hardness was measured under a load of 0.5 N. An average of the measured values for ten points was employed.

(II) 0.2% Proof Stress (Tensile Properties)

In accordance with the method for tensile test of metals as provided for in ASTM A370, a tensile test was conducted to measure 0.2% proof stress.

Test specimens according to ASTM E8, which had a test-portion diameter of 12.5 mm, were tested in accordance with ASTM A370 under the conditions of a gauge length of 50 mm and room temperature.

(III) Charpy Impact Test

Test specimens were cut out so that the longitudinal direction of each specimen coincided with the forging direction. The test specimens in the form having a 2-mm V-shaped notch were examined for impact property (absorbed energy) in accordance with ASTM A370. The test was conducted at room temperature.

Comparative Example 10 had a carbon content of 0.15%, i.e., higher than the upper limit according to the invention, and a value of Nieq of 12.9, i.e., larger than the upper limit according to the invention, and had a 0.2% proof stress higher than the target value of 1,450 MPa. However, this steel had a Charpy impact value (absorbed energy) of 5 J, below 15 J, and was insufficient in toughness.

Comparative Example 11 had a silicon content higher than the upper limit according to the invention, and had a Charpy impact value (absorbed energy) lower than 15 J, besides being poor in 0.2% proof stress.

Comparative Example 12 had a manganese content higher than the upper limit according to the invention, and had a Charpy impact value (absorbed energy) lower than 15 J, besides being poor in 0.2% proof stress.

Comparative Example 13 had a nickel content lower than the lower limit according to the invention, and had a low 0.2% proof stress.

Comparative Example 14 conversely had a nickel content higher than the upper limit according to the invention and a value of Ni/Al larger than the upper limit according to the invention, and the value of Nieq also was larger than the upper limit according to the invention. Due to the fact that the value of Nieq was larger than the upper limit according to the invention, the 0.2% proof stress of this steel was below the target value.

Comparative Example 15 had a chromium content lower than the lower limit according to the invention and a value of Creq which also was smaller than the lower limit according to the invention. As a result, the 0.2% proof stress of this steel was below the target value.

Comparative Example 16 conversely had a chromium content higher than the upper limit according to the invention and a value of Creq larger than the upper limit according to the invention. As a result, the 0.2% proof stress of this steel was below the target value.

Comparative Example 17 had a molybdenum content lower than the lower limit according to the invention and a value of Creq smaller than the lower limit according to the invention. As a result, the 0.2% proof stress of this steel was below the target value.

Comparative Example 18 conversely had a molybdenum content higher than the upper limit according to the invention, and had a Charpy impact value which was below the target value.

Comparative Example 19 had a nitrogen content higher than the upper limit according to the invention and a value of Nieq larger than the upper limit according to the invention. The 0.2% proof stress of this steel was below the target value.

Comparative Example 20 had an aluminum content lower than the lower limit according to the invention and a value of Ni/Al larger than the upper limit according to the invention. As a result, the 0.2% proof stress thereof was below the target value due to the increase in the amount of the retained austenite.

Comparative Example 21 conversely had an aluminum content higher than the upper limit according to the invention and a value of Ni/Al smaller than the lower limit according to the invention. As a result, the Charpy impact value of this steel was below the target value although the 0.2% proof stress thereof reached the target value.

Comparative Example 22 had a copper content higher than the upper limit according to the invention. This steel had a Charpy impact value which was below the target value, although the 0.2% proof stress thereof reached the target value.

Comparative Example 23 had a titanium content higher than the upper limit according to the invention and a value of Creq larger than the upper limit according to the invention. As a result, this steel had a Charpy impact value which was far below the target value, although the 0.2% proof stress thereof reached the target value.

Comparative Example 24 had a molybdenum content lower than the lower limit according to the invention but had a copper content and a titanium content which each were higher than the upper limit according to the invention. As a result, this steel had a considerably low Charpy impact value.

Comparative Example 25, which is a material corresponding to SUS630, had a low 0.2% proof stress although the Charpy impact value thereof exceeded the target value.

In contrast, Examples 1 to 7 according to the invention each had a 0.2% proof stress and a Charpy impact value which were not below the respective target values.

While the invention has been described in detail and with reference to specific embodiments thereof, it will be apparent to one skilled in the art that various changes and modifications can be made therein without departing from the scope thereof.

This application is based on Japanese patent application No. 2012-103506 filed Apr. 27, 2012 and Japanese patent application No. 2013-055435 filed Mar. 18, 2013, the entire contents thereof being hereby incorporated by reference.

What is claimed is:

1. A steel for steam turbine blades which contains, in terms of % by mass, 0.02-0.10% of C,
up to 0.25% of Si,
0.001-0.10% of Mn,
up to 0.010% of P,
up to 0.010% of S,
8.8%-10% of Ni,
10.5-13.0% of Cr,
2.0-2.5% of Mo,
0.001-0.010% of N,
1.15-1.50% of Al,
less than 0.10% of Cu,
up to 0.20% of Ti, and
the remainder being incidental impurities and Fe, and which satisfies the following expression (1), expression (2), and expression (3):

$$6.0 \leq Ni/Al \leq 8.0 \quad \text{expression (1)}$$

$$9.0 \leq Nieq \leq 11.0 \quad \text{expression (2)}$$

$$17.0 \leq Creq \leq 19.0 \quad \text{expression (3)}$$

wherein $$Nieq=[Ni]+0.11[Mn]-0.0086([Mn]^2)+0.44[Cu]+18.4[N]+24.5[C]$$

$$Creq=[Cr]+1.21[Mo]+0.48[Si]+2.2[Ti]+2.48[Al]$$

(wherein the atomic symbols in expression (1) and in the equations defining Nieq and Creq represent the contents in % by mass of the respective elements).

2. The steel for steam turbine blades of claim 1, which contains an austenite phase.

* * * * *